US011473804B2

(12) United States Patent
Chen et al.

(10) Patent No.: US 11,473,804 B2
(45) Date of Patent: Oct. 18, 2022

(54) CONTROLLING HVAC OPTIMIZATION USING REAL TIME DATA

(71) Applicant: Optimum Energy, LLC, Seattle, WA (US)

(72) Inventors: Peng Chen, Kenmore, WA (US); Ian Robert Dempster, Seattle, WA (US)

(73) Assignee: Optimum Energy, LLC, Seattle, WA (US)

( * ) Notice: Subject to any disclaimer, the term of this patent is extended or adjusted under 35 U.S.C. 154(b) by 89 days.

(21) Appl. No.: 16/863,275

(22) Filed: Apr. 30, 2020

(65) Prior Publication Data

US 2020/0355390 A1 Nov. 12, 2020

Related U.S. Application Data

(60) Provisional application No. 62/846,540, filed on May 10, 2019.

(51) Int. Cl.

| | |
|---|---|
| ***F24F 11/58*** | (2018.01) |
| ***F24F 11/63*** | (2018.01) |
| ***F24F 11/46*** | (2018.01) |
| ***F24F 11/38*** | (2018.01) |

(52) U.S. Cl.

CPC ..... *F24F 11/58* (2018.01); *F24F 11/38* (2018.01); *F24F 11/46* (2018.01); *F24F 11/63* (2018.01)

(58) Field of Classification Search

CPC .. F24F 11/58; F24F 11/38; F24F 11/46; F24F 11/63; F24F 11/54; F24F 11/64

See application file for complete search history.

(56) References Cited

U.S. PATENT DOCUMENTS

2005/0120012 A1 6/2005 Poth et al.
2011/0257795 A1* 10/2011 Narayanamurthy .. F24F 5/0046 700/277
2014/0319232 A1* 10/2014 Gourlay ..... F24F 11/62 236/1 C (Continued)

OTHER PUBLICATIONS

International Search Report and Written Opinion, dated Jul. 24, 2020 for International Application PCT/US 20/30700, 10 pages.

*Primary Examiner* — Thomas C Lee
*Assistant Examiner* — Michael Tang
(74) *Attorney, Agent, or Firm* — Seed IP Law Group LLP

(57) ABSTRACT

The present disclosure describes a solution to monitor, control and share HVAC operation state information and the analysis thereof based on a distributed computing system involving local building automation servers (BAS), a network based (cloud-based) system and client terminals. On the network based system, a client level virtual machine launches a container process for a client, which includes a background sub-process and a foreground sub-process. The background sub-process collects and analyzes HVAC data without client interaction. The foreground sub-process is setup upon the launching of the container process, but is fully activated until suitable client interaction is detected. The foreground sub-process pushes for a more comprehensive set of HVAC operation data through the BAS server and analyzes and presents the data and analysis result in substantially real time to the client through the client terminal with a higher data updating rate than the background sub-process.

19 Claims, 5 Drawing Sheets

(56) References Cited

U.S. PATENT DOCUMENTS

| | | | | |
|---|---|---|---|---|
| 2016/0098285 | A1* | 4/2016 | Davis | G06F 9/45545 718/1 |
| 2019/0108013 | A1* | 4/2019 | Duraisingh | H04L 63/00 |
| 2019/0173755 | A1* | 6/2019 | Jadhav | H04L 67/125 |
| 2020/0313925 | A1* | 10/2020 | Singh | H04L 12/403 |

* cited by examiner

CONTROLLING HVAC OPTIMIZATION USING REAL TIME DATA

BACKGROUND

Technical Field

The present disclosure generally relates to heating, ventilation, and air conditioning (HVAC) optimization. More particularly, but not exclusively, the present disclosure relates to collecting and presenting data of HVAC operation states, and controlling HVAC operation based on the data.

Description of the Related Art

Systems that heat, ventilate, and cool buildings are expensive to install and operate. Heating, ventilation, and air conditioning (HVAC) systems can in many cases be deliberately operated to improve efficiency. In these cases, a control device takes input from environmental sensors, occupancy sensors, and people, and then, based on the input, the control device can direct the operations of the HVAC system. Operating the HVAC system efficiently can provide ongoing cost savings when less energy is used to provide a sufficient level of HVAC comfort. Operating the HVAC system efficiently can also provide additional savings by extending the life of one or more components of the HVAC system when the components are used less frequently or at less than their full capability.

Some aspects of technologies and related art that may be useful to an understanding of the present invention are taught in various patent publications.

U.S. Pat. No. 5,535,814 B2 to Hartman (i.e., the '814 patent) is entitled SELF-BALANCING VARIABLE AIR VOLUME HEATING AND COOLING SYSTEM. The '814 patent teaches a variable air volume heating and cooling system that provides automatic system-wide airflow balancing. To balance the '814 patent system, the maximum airflow setting of each terminal box is automatically and continuously adjusted in response to central supply fan loading conditions together with local zone conditions. The system taught in the '814 patent has the advantage of automating both initial air balancing of terminal units at the time of installation, as well as rebalancing to respond to changing conditions, without a human technician's intervention.

U.S. Pat. No. 6,185,946 B2 to Hartman (i.e., the '946 patent) is entitled SYSTEM FOR SEQUENCING CHILLERS IN A LOOP COOLING PLANT AND OTHER SYSTEMS THAT EMPLOY ALL VARIABLE-SPEED UNITS. The '946 patent builds on certain concepts taught in the '814 patent. In addition to providing deliberate control of individual HVAC systems, it is recognized that additional efficiency gains may be made by deliberately controlling parallel units in an HVAC system. For example, the '946 patent teaches improved methods of sequencing parallel centrifugal pumps in a variable flow hydronic system, parallel fans in a variable air-flow system, and centrifugal chillers in an HVAC system having a plurality of variable speed drive centrifugal chillers arranged in parallel. In at least some methods of the '946 patent, an operating point of the on-line units can be determined, the current operating point of the on-line units can be compared to a natural curve of maximum efficiency, and certain ones of the units can be added or released to move closest to an operating curve of optimal efficiency across the system.

In still further improvements in HVAC operating efficiency, certain discoveries have been made to permit individual HVAC components to operate more efficiently using real time data collection, real time efficiency prediction, and adaptation of future operation based on the data collection and efficiency prediction. U.S. Pat. No. 8,219,250 B2 (the '250 patent) to Dempster et al. is entitled SYSTEMS AND METHODS TO CONTROL ENERGY CONSUMPTION EFFICIENCY. In the '250 patent, a controller is configured to exchange information with a building automation system (BAS). The controller includes various executable programs for determining a real time operating efficiency, simulating a predicted or theoretical operating efficiency, and making adjustments to HVAC system operating parameters. In one method taught by the '250 patent, a BAS is used to control operating efficiency of an HVAC system. The method includes the acts of (1) exchanging information contemporaneously in time between a controller and the building automation system; (2) determining an operating efficiency of the HVAC system based on the present operating state of the equipment; (3) determining a predicted operating efficiency of the HVAC system computed from installation specifications provided with the HVAC equipment; (4) comparing whether the operating efficiency is below a desired threshold relative to the predicted operating efficiency; (5) adjusting one or more HVAC system operating parameters; (6) transmitting the one or more adjustments to the BAS; and (7) triggering a self-learning feature of the controller to automatically recall the adjustment at a later time when the operating efficiency is again below the desired threshold.

FIG. 1 is a conventional energy optimization HVAC system 10. A building automation system (BAS) 12 is arranged to control a plurality of HVAC components 34. For example, the BAS 12 in FIG. 1 is arranged to direct the operations of variable frequency drives (VFD) 14, tower fans 16, chillers 18, air handling units (AHU) 20, boilers 22, variable air volume (VAV) and constant air volume (CAV) air handler units 24, pumps and valves 26, and possibly other HVAC components that are not shown.

As indicated by two-headed pointers, the BAS 12 and ones of the plurality of HVAC components 34 may establish and maintain any one or more of unidirectional communications, bidirectional communications, wired communications, wireless communications, electromechanical communications, mechanical communications, or some combination thereof. Using the means of communicating, the BAS 12 may provide control signals, status signals, parameters, or other such data to the HVAC components 34, and in some cases, one or more of the HVAC components 34 may provide control signals, status signals, error signals, stored parameters, generated data, or other information to the BAS 12.

In the conventional energy optimization HVAC system 10, an energy optimization control engine (EOCE) 50 is communicatively coupled to the BAS 12. The EOCE 50 may provide control information to direct energy efficiency operations of the BAS 12 according to the '814 patent, the '946 patent, the '250 patent, or some other protocol.

Implementation of the conventional energy optimization HVAC system 10 is a process that requires several people. The people may include any one or more of building site owner/managers 28*a*, energy optimization provider representatives 28*b*, energy optimization engineers 28*c*, and others associated with a particular building or building site such as controls engineers, integration engineers, maintenance engineers, service engineers, and the like, which are referred to herein as building engineers 28*d*. Each of the people associated with the conventional energy optimization HVAC system 10 may have access to a user computing device 32. Via a wide area network (WAN) 30 such as the Internet and an associated user computing device 32, the people associated with the conventional energy optimization HVAC system 10 may communicate with each other and with others. In some cases, certain ones of those associated with the conventional energy optimization HVAC system 10 use a user computing device 32 to communicate with one or more of the EOCE 50, the BAS 12, and the plurality of HVAC components 34.

One operational use of the conventional energy optimization HVAC system 10 is now described. In this scenario, BAS 12 and the plurality of HVAC components 34 are installed in a building complex without an EOCE 50. The building site owner/manager 28*a* recognizes very high energy and maintenance costs in the building complex, and in an effort to reduce the energy and maintenance costs, the building site owner/manager 28*a* contacts an energy optimization provider representative 28*b*.

The energy optimization provider representative 28*b* engages help from the building site owner/manager 28*a*, an energy optimization engineer 28*c*, and a building engineer 28*d*. Using the BAS 12, the building engineer 28*d* collects certain data from the BAS 12 and any number of the plurality of HVAC components 34. The information, which may include "on" times, "off" times, alerts, temperature data, humidity data, air flow data, and other such information, is communicated to the energy optimization provider representative 28*b*. The collected information may be collected instantaneously as a "snapshot," or the information may be collected over hours, days, weeks, or months.

Using the collected building complex information provided by the building engineer 28*d*, the energy optimization engineer 28*c* creates a particular configuration of an EOCE 50, which is customized to the building complex and the installed BAS 12 and HVAC components 34. In some cases, the particular configuration may include hardware, software, or a combination of hardware and software. Once so customized, the EOCE 50 is delivered to the building complex and installed. The installation may be performed by the building engineer 28*d*, the energy optimization engineer 28*c*, others, or some combination of these. Presumably, once installed, the EOCE 50 will operate well and improve the energy usage of the building complex.

In some cases, the EOCE 50 is able to communicate, via the WAN 30, to provide information to the energy optimization provider representative 28*b*. This information may be provided automatically, manually, or by some other process. Using the communicated information, the energy optimization provider representative 28*b*, the energy optimization engineer 28*c*, or others, are able to assess the energy optimization performance of the EOCE 50. Based on failures, if any, and further based on additional discovered optimizations or for other reasons, it may be determined that improvements can be made to the EOCE 50.

If it is determined that improvements are to be made to the EOCE 50, additional building data may be collected, and the energy optimization engineer 28*c* can generate a new configuration for EOCE 50. The new configuration may include new hardware, new software, or both new hardware and new software. After being generated, the new configuration is delivered to the building complex and installed by the building engineer 28*d*, the energy optimization engineer 28*c*, others, or some combination of these.

Each time it is determined that improvements or other changes are to be made to the EOCE 50, the same time-intensive, expensive, manual processes to collect data, generate a new configuration for EOCE 50, and install the new configuration are followed.

All of the subject matter discussed in the Background section is not necessarily prior art and should not be assumed to be prior art merely as a result of its discussion in the Background section. Along these lines, any recognition of problems in the prior art discussed in the Background section or associated with such subject matter should not be treated as prior art unless expressly stated to be prior art. Instead, the discussion of any subject matter in the Background section should be treated as part of the inventor's approach to the particular problem, which, in and of itself, may also be inventive.

BRIEF SUMMARY

Due to the critical benefits that heating ventilation and air conditioning (HVAC) equipment provides for people and property, and the inability to tolerate a loss of equipment operation, the installation and activation of an HVAC energy optimization control system has conventionally been expensive and time-consuming. The conventional process requires a substantial amount of onsite manual data collection followed by a substantial amount of offsite software programming and configuration. Later, in the conventional process, the energy optimization control systems that have been custom developed for a particular site are manually deployed at the building site where the HVAC equipment operates.

The present disclosure describes a solution to monitor, control and share HVAC operation state information and the analysis thereof based on a distributed computing system involving local building automation servers (BAS), a network based (cloud-based) system and client terminals. On the network based system, client registration for the real time HVAC monitoring and control service is established, and a client level virtual machine is generated and assigned to the registered client. The client level virtual machine includes one or more container processes, each including a background sub-process and a foreground sub-process. The background sub-process is launched immediately upon the starting of the service through the client level virtual machine and operates without interaction with the client. The background sub-process collects a smaller set of data on the operation of the HVAC devices through one or more related building automation system (BAS) servers and analyzes the data for routine control function to maintain the routine operation of the HVAC devices concerned by the registered client in the registration with the cloud system.

The foreground sub-process is also set up upon the launching of the container process, but it may not be fully activated until suitable client interaction is detected. Upon detecting a suitable client interaction, e.g., client activating a webpage for the foreground sub-process, the foreground sub-process may push a more comprehensive set of HVAC operation data through the BAS server and analyze and present the data and analysis result in substantially real time to the client through a client terminal, e.g., a client application installed on a client computing device. The foreground sub-process presents the most updated data and analysis starting from the time point of detecting client interaction, and historical data and analysis, e.g., from the background sub-process, may be combined with the most updated data and analysis. In an embodiment, the foreground data is collected and presented to the client with a higher updating rate than the background sub-process.

With the data and analysis presented through the foreground sub-process, a user may be able to detect a fault condition in the operation of the concerned HVAC device and may correct the fault condition through the foreground sub-process and the related BAS. The background sub-process may also correct fault conditions in the routine operation of HVAC device and analyze the fault conditions to generate the historical record of the HVAC operation.

The present disclosure describes several tools and methods that advance the HVAC energy optimization field of technology. The innovation described in the present disclosure is new and useful, and the innovation is not well-known, routine, or conventional in the energy optimization industry. The innovation described herein uses some known building blocks combined in new and useful ways along with other structures and limitations to create something more than has heretofore been conventionally known. The embodiments improve on HVAC operational computing systems, which, when un-programmed or differently programmed, cannot perform or provide the specific HVAC energy optimization development and deployment features claimed herein.

The embodiments described in the present disclosure improve upon known HVAC energy optimization processes and techniques. Along these lines, the embodiments described herein improve on the specific computing devices that implement the HVAC energy optimization processes and techniques described herein. For example, scaling update rates based on background and foreground processes, presentation focus, and for other reasons saves additional energy in both the computing systems that implement the features described herein and in the network infrastructure that passes communications between the various components described herein. In addition to saving energy, the systems and methods of the present disclosure further provide more efficient and faster computing, actual and apparent speed increases when presenting information through a presentation device, and other such improvements.

The computerized acts described in the embodiments herein are not purely conventional and are not well understood. Instead, the acts are new to the industry. Furthermore, the combination of acts as described in conjunction with the present embodiments provides new information, motivation, and commercial or other business results that are not already present when the acts are considered separately.

There is no prevailing, accepted definition for what constitutes an abstract idea. To the extent the concepts discussed in the present disclosure may be considered abstract, the claims present tangible, practical, and concrete applications of said allegedly abstract concepts that are substantially more than previously known.

The embodiments described herein use computerized technology to improve the technology of HVAC energy optimization, but other techniques and tools remain available to deploy HVAC optimization programming. Therefore, the claimed subject matter does not foreclose the whole or even substantial HVAC optimization programming technological area.

These features with other objects and advantages which will become subsequently apparent reside in the details of construction and operation as more fully described hereafter and claimed, reference being had to the accompanying drawings forming a part hereof.

This Brief Summary is provided to introduce certain concepts in a simplified form that are further described in the Detailed Description. Except where otherwise expressly stated, if at all, the Brief Summary does not identify key or essential features of the claimed subject matter, nor is it intended to limit the scope of the claimed subject matter.

BRIEF DESCRIPTION OF THE SEVERAL VIEWS OF THE DRAWINGS

Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. One or more embodiments are described hereinafter with reference to the accompanying drawings in which.

DETAILED DESCRIPTION

Figure 1:
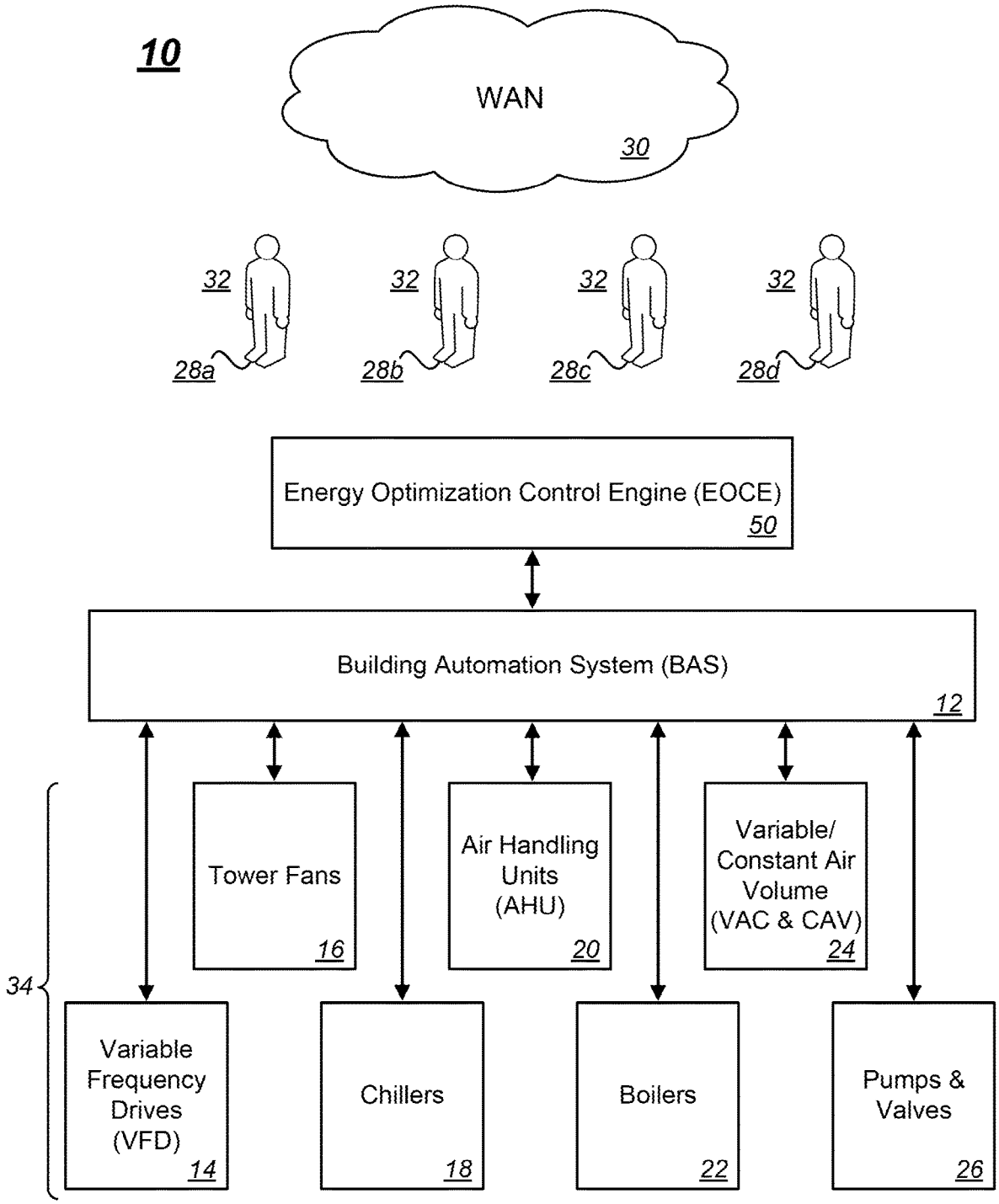
FIG. 1 (Prior Art)
FIG. 1 is a conventional energy optimization HVAC system.

Embodiments of the present invention are directed toward improvements the efficiency in the operation of the computing structures in collecting and presenting data with respect to the operation of the HVAC devices and controlling the operation of the HVAC devices based on the efficiently collected and presented information. In an embodiment, the efficiency is achieved through effective establishment and management of virtual machines and one or more container processes operated via the virtual machines for each client such that, for example, the computing resources could be efficiently distributed among multiple building automation system (BAS) servers, acting as host servers for the virtual machines, and/or a central server, and the hardware resources can be productively allocated among multiple virtual machines based on the interactive actions of a user or a client computing device of the user.

In the example embodiments now introduced, one or more energy optimization control devices are installed in a building location. After installation, the energy optimization control device is powered up and brought "online" through an embedded or external communication hub, e.g., a connected device, via a network connection. Once online, the energy optimization control device is activated and configured based on the HVAC devices within the building and controlled by the energy optimization device. For example, remotely, energy optimized programming logic is generated for the specific building and deployed into the energy optimization control device. Certain setup and configuration software files are installed on the energy optimization control device, and then the energy optimization control device is initialized with the HVAC optimization programming that was remotely generated.

The configuration of the energy optimization device may be based on information associated with the building, information associated with the HVAC equipment installed in the building, and utility and environmental information from third-party sources. For example, a remote computing system administered by the provider of energy optimization services validates a deployable installation in the energy optimization control device, and the energy optimization control device is instantiated and permitted to operate. Henceforth, the energy optimization control device can continue to provide HVAC operational data to the remote computing system, and when sufficient improvements can be achieved, the remote computing system generates and automatically downloads and deploys improved energy optimized programming logic.

The present disclosure may be understood more readily by reference to the detailed description of the embodiments. The terminology used herein is for the purpose of describing specific embodiments only and is not limiting to the claims unless a court or accepted body of competent jurisdiction determines that such terminology is limiting. Unless specifically defined herein, the terminology used herein is to be given its traditional meaning as known in the relevant art.

Prior to setting forth additional details, it may be helpful to an understanding of the present disclosure to first set forth certain terms that are used hereinafter.

HVAC system. An HVAC system or device, as the term is used herein, is broadly understood as a system or device in, or otherwise associated with, a structure, such as a building, that performs any one or more of heating, ventilating, and air conditioning. An HVAC system may stand-alone, or multiple HVAC systems may cooperate with one another in any beneficial combination. One or more HVAC systems may be deployed in a single building structure. Alternatively, one or more HVAC systems may be deployed in a plurality of building structures, and in these cases, the building structures may be arranged in a single campus, or the structures may be arranged in multiple campuses that are remote from each other. An HVAC system, exemplarily and not exhaustively, may include any one or more of building automation systems (BAS), energy optimization controllers, variable frequency drives (VFD), tower fans, chillers, air handling units (AHU), boilers, variable air volume (VAV) and constant air volume (CAV) air handler units, pumps, valves, humidifiers, dehumidifiers, and possibly other components that provide supporting functions to the HVAC system. With respect to data collection and HVAC control, BAS may be treated as separated from other components and/or devices in the HVAC system, which are referred to herein, individually or collectively, as "HVAC devices." So, as used herein, an HVAC system includes at least one BAS and any number of HVAC devices.

Optimize. The term, "optimize," in all of its grammatical constructs, throughout the present specification and claims, when used in the context of "energy optimization" does not mean "optimum" in the general sense. Energy optimization refers to the individual, collective, or individual and collective control or direction of one or more HVAC components such that an improvement to the HVAC system is achieved. The improvement may be any one or more of: desirably increased heating, ventilation, or air conditioning; desirably decreased heating, ventilation, or air conditioning; reduced energy usage while retaining an acceptable level of HVAC performance; reduced cost of operating the particular HVAC system while retaining an acceptable level of HVAC performance; reduced maintenance of one or more components of the particular HVAC system; increased service life of one or more components of the particular HVAC system, or other like improvements. Energy optimization may occur in steps over time. A single HVAC system may be energy optimized one time, two times, or many times. Energy optimization may be achieved as a result of any number of factors considered independently or comprehensively in directing the operation of the particular HVAC system. Such factors include, exemplarily and not exhaustively, measured, calculated, or measured and calculated operating efficiency of one or more HVAC components, predicted operating efficiency of one or more HVAC components, time of day, geographic location, current weather, predicted weather, source of energy, cost of energy, and current data from any number of input sensors (e.g., light, temperature, occupancy, ingress/egress sensors, and the like).

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with computing systems including client and server computing systems, as well as networks, have not been shown or described in detail to avoid unnecessarily obscuring descriptions of the embodiments.

Figure 2:
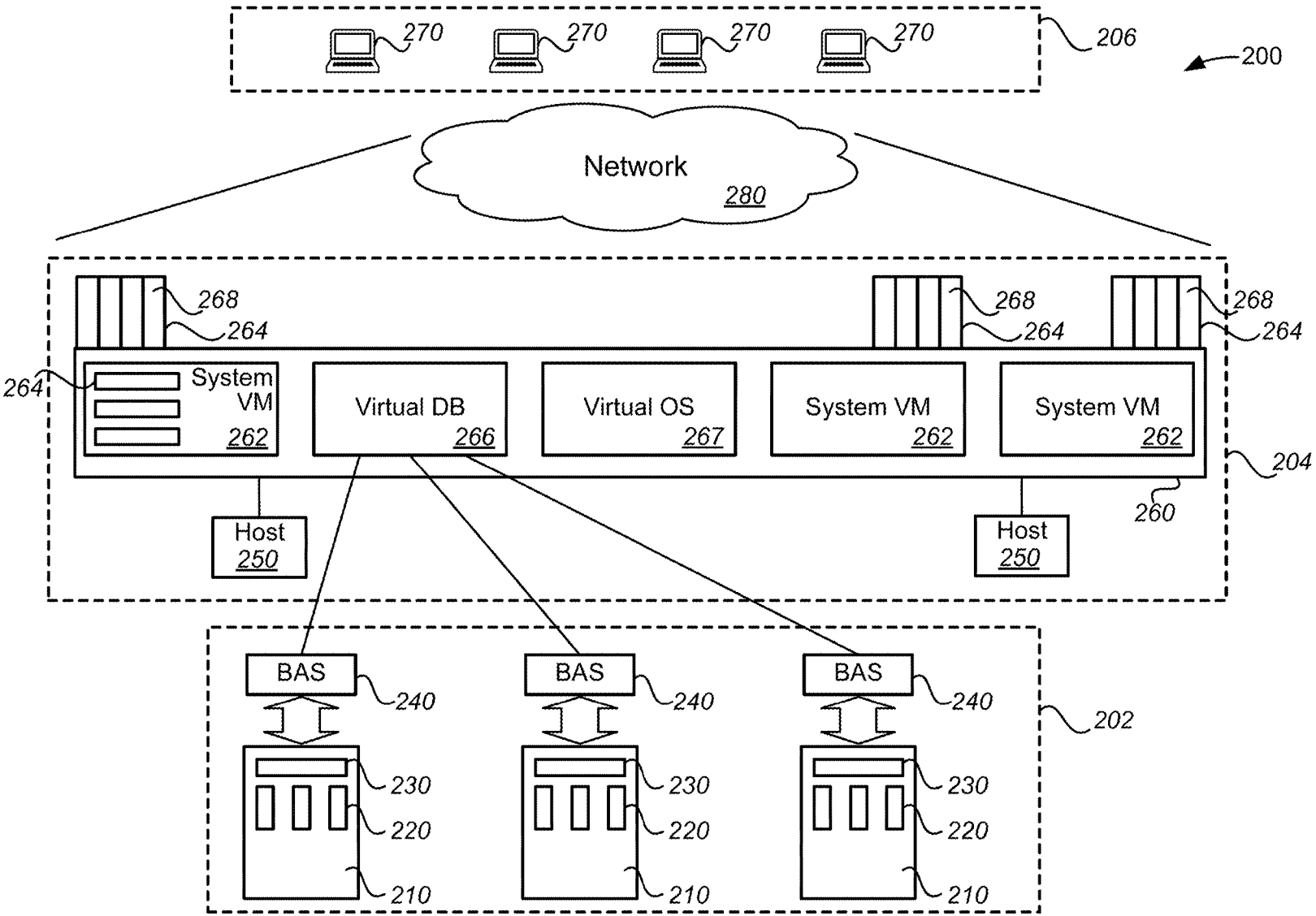
FIG. 2 is an energy optimization HVAC system arranged for monitoring, analyzing and controlling the HVAC devices.

FIG. 2 illustrates an HVAC energy optimization system 200. Referring to FIG. 2, system 200 may include a local sub-system 202, a cloud sub-system 204 and remote client 206. In local sub-system 202, multiple building structures 210 each include multiple HVAC devices 220 and one or more HVAC energy optimization devices ("control device") 230. Control device 230 may be embedded on one or more HVAC devices 220 or may be a stand-alone device. One or more of HVAC devices 220 or control devices 230 associated with each building 210 may be communicatively coupled to a building automation system/server (BAS) 240 associated with the building 210. Control device 230 and BAS 240 may function together in controlling a plurality of HVAC devices 220 as a local system (control device 230) and a remote system (BAS 240), respectively. For example, each building 210 may include a control system 230 controlling the HVAC devices 220 installed in the building 210 and a single BAS 240 may be associated with control systems 230 of multiple buildings 210. In another embodiment, a BAS 240 may be dedicated to a single building 210, where the functions of the control device 230 and the BAS 240 are integrated into a single physical system, referred to as BAS 240 for simplicity. Other embodiments with different arrangements of these systems and sub-systems are of course contemplated.

HVAC devices 220 may be any indoor climate or environment control devices and peripheral equipment thereof, including, but not limited to, variable frequency drives (VFD), tower fans, chillers, air handling units (AHU), boilers, variable air volume (VAV) and constant air volume (CAV) air handler units, pumps and valves, and other possible devices/components suitable for modulating indoor environment, e.g., temperature, humidity, air quality, noise cancellation, air circulation, lighting, etc.

Building 210 may be any a single building structure or may be a campus of two or more buildings. The building 210 may be commercial structures such as office buildings, warehouses, buildings of public access (e.g., schools or other government buildings, hospitals, entertainment venues such as stadiums and theaters, banks, retail establishments, dining establishments, hotels or other buildings of accommodation, and the like), industrial buildings, and the like. Building 210 may also be large-scale residential structures like a co-op apartment structure that includes many HVAC units 220 within each individual co-op unit and in public/shared areas.

In some cases, the BAS 240, including or together with the control device 230, performs some functions along the lines of the BAS 12 of FIG. 1. As discussed in the present disclosure, however, the BAS 240 of FIG. 2 is structured differently from the BAS 12 of FIG. 1, and the BAS 240 performs additional/different functions or performs functions differently than corresponding functions performed by the BAS 12.

The HVAC components 220 of FIG. 2 may be along the lines of the HVAC components 34 of FIG. 1. In at least some embodiments, one or more of the HVAC components 220 of FIG. 2 are identical to corresponding HVAC components 34 of FIG. 1. In other embodiments, one or more of the HVAC components 34 of FIG. 2 have features that implement, complement, or otherwise support the functionality of the BAS 240 and/or control device 230. For example, in an embodiment, the control unit 230 is embedded on an HVAC unit 220 such that the HVAC unit 220 is a smart/connected HVAC 220.

In the description hereinafter, the functions of the control unit 230 will be described either with the BAS 240 or with the HVAC 220 and there will be no separate description of the structures and/or functions of control device 230. However, it should be appreciated that a separate control device 230 is possible and included in the disclosure, which can implement part of the functions of the BAS 240 and/or the HVAC 220.

The two-headed pointers in FIG. 2 involving the BAS 240 indicate a communication link(s) that may establish and maintain any one or more of unidirectional communications, bidirectional communications, wired communications, wireless communications, electromechanical communications, mechanical communications, or some combination thereof. Using the means of communicating, the BAS 240 is arranged to provide any one or more of control signals, status signals, parameters, and other such data to the HVAC components 220. In some cases, one or more of the HVAC components 220 provide control signals, status signals, error signals, stored parameters, generated data, or other information to the BAS 240. For example, information identifying the plurality of HVAC components 220 coupled to the BAS 240, operational control parameters for each of the plurality of HVAC components 220, and measured operation state data associated with each of the plurality of HVAC components 220, may be exchanged through the communication links 242 and 244.

Cloud-based sub-system 204 may be implemented through virtual machines. In an embodiment, host server(s) 250 may be a separate computing device from BAS 240 or may be implemented using one or more of BAS 240. Host servers 250 may function together in a distributed computing scheme to support a virtual layer 260 which includes a plurality of system level virtual machines (VM) 262 that each include a plurality of client level VMs 264. Virtual layer 260 may be any level of virtualization, namely total virtualization, OS level virtualization, application level virtualization, or some other level of partial virtualization. In some examples, virtual layer 260 includes multiple tiers of virtual machines. For example, virtual layer 260 may include a shared virtual database 266 and a shared virtual OS 267 for all of the individual virtual machines 262.

System VMs 262 may each be generated for a specific category or categories of HVAC monitoring, analysis and control functions/services accessible through the cloud system 200.

Each individual client level VM 264 may be configured to implement one or more of applications, namely container process 268, included in the system level VM 262. The container process 268 may be individualized for each individual client VM 264 and may be set up based on client requirements for each client VM 264. In an embodiment, a client VM 262 may be set up for a client 270 (shown as a client computing device). For example, a client VM 264 may be generated or assigned to a client 270 based on the client's 270 requirements on data monitoring, data analysis and HVAC control of a certain HVAC devices 220. For example, different clients 270 may be concerns of different buildings 210 and/or different HVAC devices 220 in their data monitoring, analysis and climate control needs.

In an embodiment, a client VM 264 may include any number of foreground sub-processes (applications) and background sub-processes (applications). The foreground sub-process includes collecting, analyzing and actively displaying information and analysis results through client computing device 270 upon client interaction. The background sub-process includes collecting data and conducting data analysis without client interaction. In an embodiment, a foreground sub-process includes higher priority in the assignment of resources, e.g., computing, communication, and/or storage resources, over the background sub-process. Further, for a foreground sub-process, client VM 264 may include one or more of a client side application and a cloud side application. Cloud side applications may be installed and supported through host server 250, and client side applications ("client terminal") may be installed on client computing device 270.

Client computing devices 270, virtual machines 262/264, host server 250 and/or BAS 240 may communicate with one another through network 280, e.g., internet.

Figure 3:
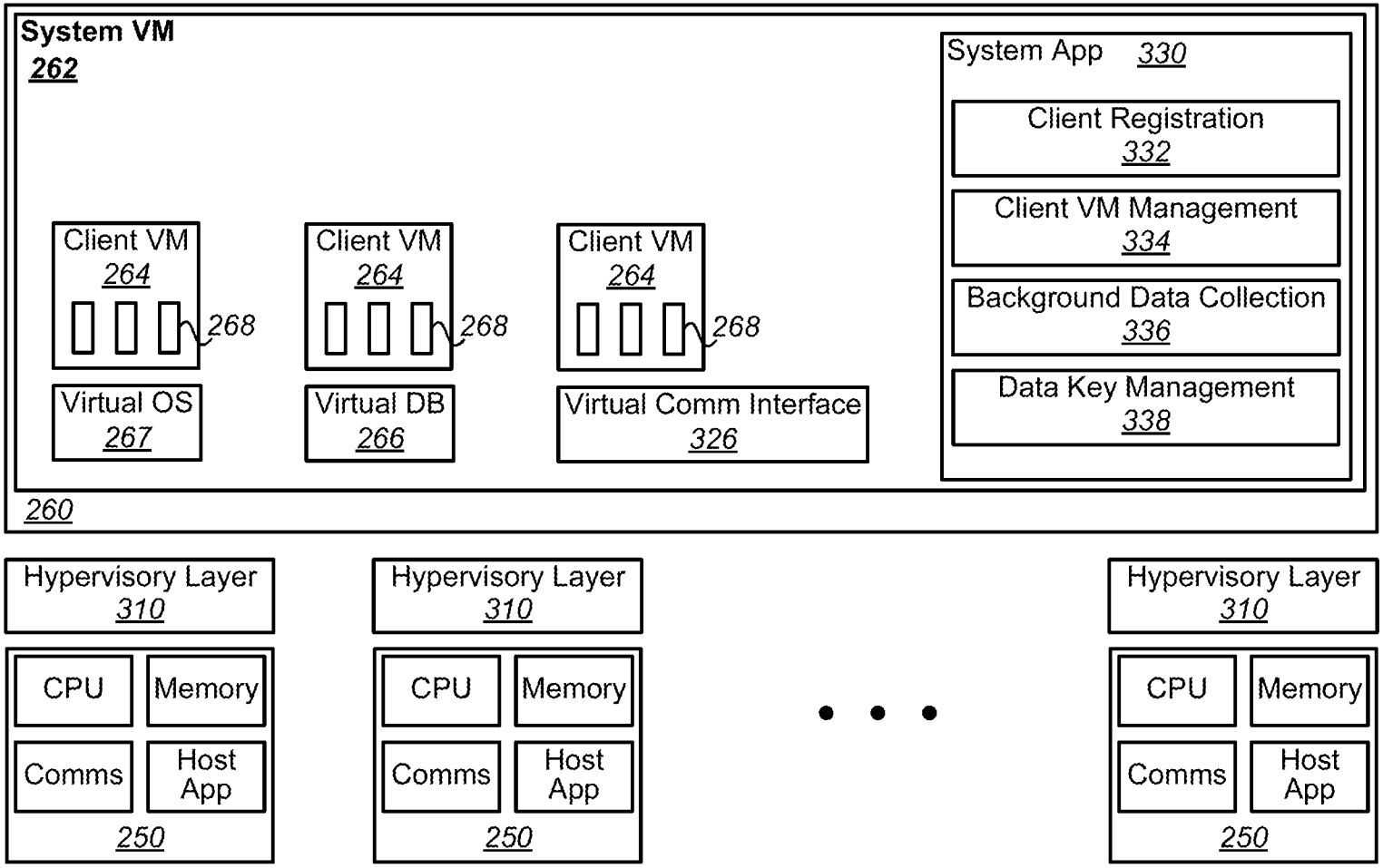
FIG. 3 is an example cloud-based system.

Referring to FIG. 3, details of an example system VM 262 (one is shown for simplicity) in virtualization layer 260 is illustrated. One or more host servers 250 may support virtualization layer 260 that is on top of a hypervisor layer 310 of the host server 250. In virtualization layer 260, a higher hierarchical virtual instance 262, referred to herein as "system VM 262," may abstract hardware resources of CPU, memory and communication capacities of host servers 250, and allocate such resources into lower hierarchical virtual machines 264, referred to herein as "client VM" 264. System VM 262 may include or share virtual OS 267, virtual database 266 and a virtual communication interface 326 that is configured to exchange data or otherwise communicate data with BAS 240.

System VM 262 may also include a system application 330 that includes a client registration unit 332, client VM management unit 334, background data collection unit 336, and data key management unit 338.

System VM 262 may include multiple client VMs 264, each for a registered client 270, shared between a plurality of clients 270, or having multiple client VMs 264 assigned to a single client 270. Client VMs 264 include container processes 268 specifically created based on the registration of the respective client 270. That is, the container processes 268 are generated according to the request of client 270 upon registration with a specific system level VM 262, i.e., for an HVAC monitoring, analyzing and control service.

A container process 268 may include a foreground sub-process and a background sub-process. The foreground sub-process and background sub-process may be related to one another in a sense that they are concerning the same set of target HVAC devices 220 requested by the registered client 270. The foreground sub-process and the background sub-process are different from one another in the set of data involved, the rate of data updating, and the ways of using the data. The foreground sub-process and the background sub-process may also involve different sets of related HVAC devices 220 in the data collecting and control because different categories of data collected and controlled under the two sub-processes may involve different related HVAC devices 220 under data dependency and control dependency among HVAC devices 220.

In the background sub-process, a first set of data, usually a smaller group of data categories with respect to the operating state of the HVAC devices and/or other related information, may be received and analyzed as a backend process, i.e., without interaction with client 270 and without being presented to client 270. For example, operation state data of target HVAC devices 220 may be received and analyzed to automatically control the operation of HVAC devices 220 according to established control parameters under the specific client VM 264 based on client registration. The background data may also be used for the purposes of machine learning and artificial intelligence as the historical performance records of the target HVAC devices 220. For example, the background sub-process may generate any number of key performance index ("KPI") values of each of the concerned HVAC devices 220. The results of the background sub-process, although not presented in real time to the client 270, may be used in a subsequent foreground sub-process of the same container process 268. For example, historical KPI values, or information representative of any such KPI values, may be presented to client 270 together with real time HVAC data in a foreground sub-process. In an embodiment, a background sub-process receives data in a slower updating rate than a foreground sub-process of the same container process 268. In an embodiment, the data receiving for the background sub-process is automatically launched upon the establishment of the client VM 264 or the launching of the container process 268 and will continue regularly until or unless the client VM 264 is terminated or modified to remove the respective container process 268.

In the foreground sub-process, a second set of data, usually including more categories of data with respect to the operating state of the HVAC devices 220 and/or other related information may be collected, analyzed and presented to client 270 through client terminal 270, e.g., via a multimedia display thereof. In the foreground sub-process, the collected data or an analysis product based on the collected data is presented to the client 270 in substantially real time and in a prospective manner, namely only the most updated data or data product is presented. The most updated data may be generated using, at least partially, the historical data. For example, the most updated KPI trend data may include the historical KPI values.

In operation, specifically, client registration unit 332 is configured to receive a request from a client 270 on monitoring, analyzing and/or controlling one or more target HVAC devices 220 or a building 210 for total energy efficiency/optimization. The request may indicate the specific HVAC units 220 concerned by the client "target HVAC devices 220", the energy efficiency requirements of the client 270, a desired balance between energy saving and HVAC performance, etc. In an embodiment, the client registration may be implemented through a dedicated internet webpage accessible through network 280, through a dynamically generated webpage, or via some other interface.

Based on the received client request, and upon registration, client VM management unit 334 may assign a client VM 264 to the client 270. The client VM 264 includes one or more container processes 268 specifically configured or otherwise arranged based on the client request. For example, the sets of data for the foreground and background sub-processes, the data analysis schemes and the HVAC control schemes may all be tailored based on the client request.

Client VM management unit 334 may also cause to be installed a client side application, referred to as a "client terminal," onto client computing device 270.

In another embodiment, additionally or alternatively, the client terminal 270 is also implemented through a website using a uniform resource locator (URL) leading to the tailored webpage under the client VM 264.

Upon the establishment of the client VM 264, the respective one or more container processes 268 may be ready to be launched. In an embodiment, the respective background sub-process is launched automatically without interaction with client 270, while the foreground sub-process is launched as inactive and then later activated upon client 270 interaction. For example, when client 270 activates the webpage of the client VM 264 and clicks on a tab for the specific container process 268, the foreground sub-process may be activated.

Background data collection unit 336 may be configured to collect data from target HVAC devices 220 and/or other HVAC devices 220 ("related HVAC devices") in buildings 210 relevant to the concerned indoor climate control and energy total optimization. In an embodiment, as the data for the background sub-process may be shared among multiple different client VMs 264 and may be received from BAS 240 following the same path and/or updating rate, the receiving of the data for the background sub-processes may be implemented on the system VM 320 level as illustrated and described here. However, it should be appreciated that the receiving of the data for the background sub-process ("background data") may also be implemented under client VM 264, e.g., in a case that the client VM 264/container process 268 is different from other client VM 264 in the data requirements for the background sub-process.

The background data may be stored in virtual database 266 and then retrieved by client VMs 264 or fetched to (e.g., pushed) client VMs 264. In an embodiment, background data receiving unit 336 may receive the background data from BAS 240 and/or building 210 under a first updating rate. Such received background data may be fetched to or retrieved by client VMs 264 or container process 268 thereof under a second data updating rate, which may or may not be equal to the first updating rate.

In some cases, data key management unit 338 is configured to generate and assign an authentication key for data exchange related to each client VM 264. The authentication key may be shared with BAS 240. In an embodiment, BAS 240 uses the authentication key to authenticate a data receiving/collection request for a client VM 264 and embeds the authentication key in any data provided for the client VM 264 including the data for the background sub-processes. Similarly, a client VM 264 or a container process 268 thereof may only accept data that includes the embedded authentication key assigned to the client VM 264 or the container process 268.

In some embodiments, the authentication key may be dynamically and/or randomly generated and may be encrypted and decrypted under the private key/public key schemes, which are all included in the disclosure.

Figure 4:
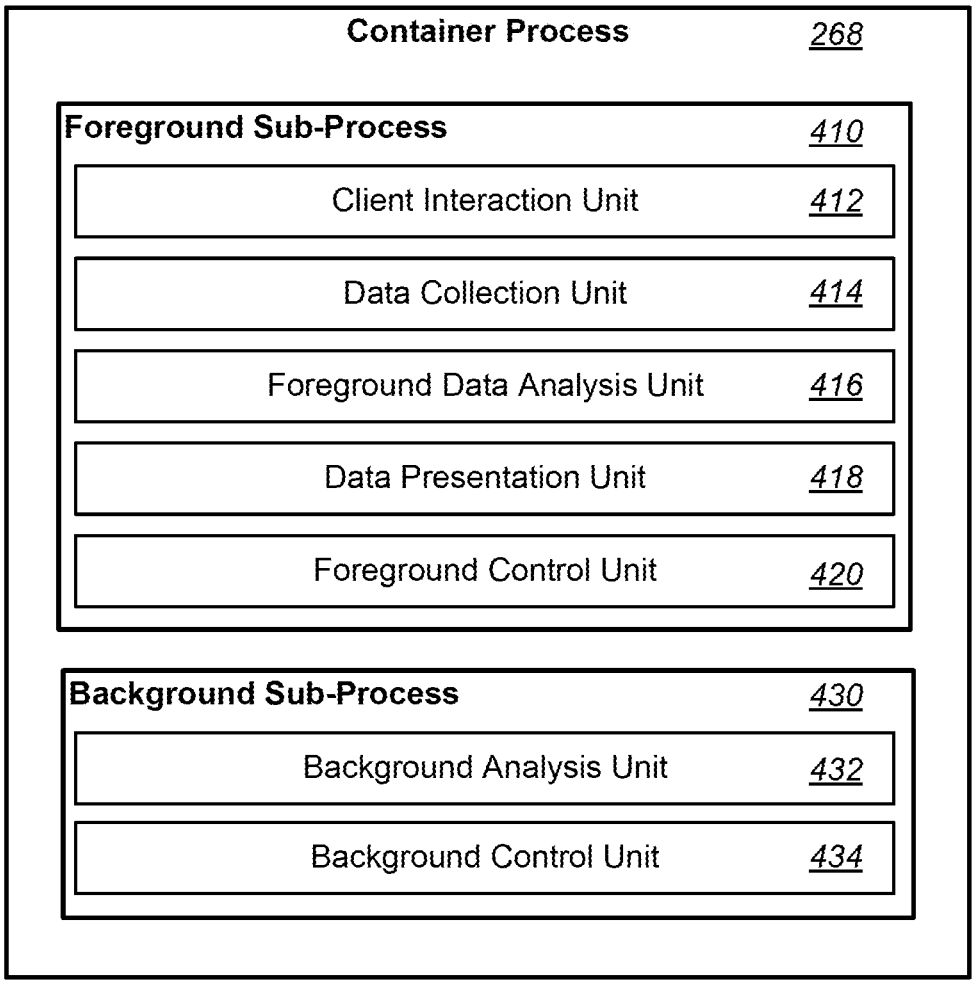
FIG. 4 is an example client virtual machine.

FIG. 4 illustrates an example container process 268 of a client VM 264. Referring to FIG. 4, container process 268 may include a foreground sub-process 410 and a background sub-process 430. The foreground and background sub-processes 410, 430 are created as a pair and are related to one another in various aspects. For example, the data set used in the foreground sub-process ("foreground data") may overlap, or specifically include, the data set used in the background sub-process ("background data"), although the foreground data includes more data categories and is updated more frequently, namely collected with a higher updating rate. Further, the data analysis results of the background sub-process 430 may also be used in the data analysis and data presentation in the foreground sub-process 410.

Specifically, foreground sub-process 410 may include a client interaction unit 412, a data collection unit 414, a foreground data analysis unit 416, a data presentation unit 418 and a foreground control unit 420. Background sub-process 430 may include a background analysis unit 432 and a background control unit 434.

Client interaction unit 412 may be configured to detect a client interaction event to activate the foreground process 410. Note that in at least some embodiments, the foreground process 410 is launched when container process 268 is launched, but the foreground process is not fully activated until a client interaction event is detected. A client interaction event may include that a client activates a related webpage for the data monitoring, a click on a tab for a specific data monitoring program under the foreground sub-process, a pre-defined gesture, a voice command, or any other client interactions defined/categorized as indicating that the client 270 desires to monitor, bring into focus, or otherwise capture or present determined details of the HVAC 220 operation in a building 210 in real time. Client interaction unit 412 may also be configured to manage a termination of the foreground sub-process 410. For example, client interaction unit 412 may keep monitoring interactive activities on the client 270 side together with a threshold interval during which the foreground sub-process is maintained as active. If no client interactive activity is detected within the threshold interval, client interactive unit 412 may terminate or pause the foreground sub-process 410.

Data collection unit 414 is configured to push a data collection request toward one or more BAS 240 for a (second) set of data for the foreground sub-process 410. In an embodiment, a mailbox process is established between data collection unit 414 and relevant BAS 240 for the foreground data collection. The second set of data usually is more comprehensive in data categories than the first set of data for the background sub-process 430, but this is optional. The required updating rate for collecting and transmitting the second set of data is higher than the background data in many embodiments, however there may be cases where the updating rate for collecting and transmitting the second set of data is the same or lower than the background data. Considering the case where the updating rate for collecting and transmitting the second set of data is higher than the background data, the collection of the second set of data, namely the foreground data, is not under the normal data receiving routine like the background data and the data collection unit 414 specifically requests BAS 240 to collect data for this foreground sub-process 410 with the higher updating rates.

In an embodiment, the foreground data collected from BAS 240 is also fetched into the virtual database 266. The second set of data may be so identified and be given a higher priority in the database operations, e.g., priority in queuing of data reading and/or writing over the background data. Further, the virtual database 266 may include multiple partitions dedicated for the foreground data and for the background data.

In an embodiment, the virtual communication interface 326 may give a higher priority in the data receiving and dispatching for the second set of data of the foreground sub-process than the background data.

Foreground data analysis unit 416 is configured to analyze the second set of data, i.e., the foreground data, under the client request. For example, the analysis may determine whether the target HVAC devices 220 are operating in a manner that achieves a total energy optimization or total balance between energy efficiency and indoor climate control performance.

Data presentation unit 418 is configured to cause the HVAC data and/or data analysis results be presented to a user through client computing device 270. The data presentation may be achieved through a dedicated client terminal, namely client side application install on client computing device 270, or may be achieved through a webpage linked to the client VM 264. In some cases, the information may instead be "presented" into a data collection repository such as a database for a presentation that is offset in time. In an embodiment, the data presentation to client computing device 270 is conducted in substantially real time and includes only the most updated data, including the HVAC data collected from BAS 240 and/or data analysis results of foreground data analysis unit 416.

Foreground control unit 420 is configured to control, via instructions or control parameters to BAS 240, the operation of HVAC devices 220 based on the data analysis results of foreground data analysis unit 416 and/or user inputs. For example, when the user identifies a fault condition on one or more target HVAC devices 220 through the presented foreground data and/or data analysis results, the user may input through the foreground control unit 420 an HVAC correction data to control the operation of the target HVAC devices 220.

Background data analysis unit 432 is configured to analyze the first set of data received under the background sub-process. In an embodiment, the analysis is for the purpose of maintaining the normal/routine operation of target HVAC devices 220 under the preset operation parameters and/or preset optimization parameters. For the background analysis, client interaction may not be needed. That is, the analysis results may be stored for historical analysis purpose and for later presentation to the user/client 270 as part of the foreground sub-process 410, but the analysis results may not be presented to the client 270 in real time.

Background control unit 434 is configured to control the operation of target HVAC devices 220 based on the background analysis results without user/client 270 inputs. Background control unit 434 may determine at least one of a climate control performance parameter and an energy saving parameter. For example, some operation parameters of HVAC devices 220, either individually or as a group of total energy optimization control, may be set up through foreground control or through a system setup and the background control unit 434 may function to monitor and maintain that the operation parameters are met. For example, the foreground control may set up that the energy consumption of a specific group of HVAC units 220 be within a range. If the background data and/or the background analysis results indicate that the energy consumption of the group of target HVAC units 220 is beyond the preset range, background control unit 434 may determine and selectively control, through relevant BAS 240, to adjust the energy consumption states of some HVAC units 220 in the group.

Figure 5:
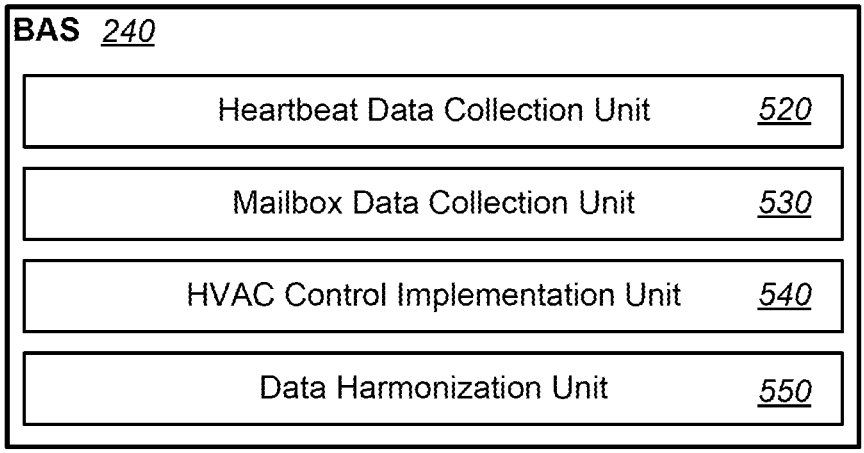
FIG. 5 is an example building automation server.

FIG. 5 illustrates an example BAS 240. BAS 240 includes a heartbeat data collection unit 520, a mailbox data collection unit 530, an HVAC control implementation unit 540, and a data harmonization unit 550.

Heartbeat data collection unit 520 is configured to collect the first set of operation state data from HVAC units 220 for the background sub-process 430 of container process 268. In an embodiment, multiple container processes 268 or multiple client VMs 264 may share the background data collected from a same HVAC unit 220. Therefore, heartbeat data collection unit 520 may collect operation state data from HVAC units 220 in a manner that is independent from a specific client VM 264 and/or a container process 268. For example, heartbeat data collection unit 520 may collect operation state data from an HVAC unit 220 following a frequency faster than the updating rate of a background sub-process 430 of a container process 268. In an embodiment, the data collection frequency of the heartbeat data collection unit 520 may be even faster than the data updating rate of a foreground sub-process 410. The operation state data collected by the heartbeat data collection unit 520 may also be used for a foreground sub-process 410.

In an embodiment, the data collected by the heartbeat data collection unit 520 is fetched to background data collection unit 336 either directly or through virtual database 266.

Mailbox data collection unit 530 is configured to collect operation data under the mailbox process established by data collection unit 414 of foreground sub-process 410. The data collection under the mailbox process is a customized process as compared to the routine process of the background data collection. For example, the category/type of operation data, the target HVAC devices 220, and the updating rate for data collection may be customized for a mailbox process. As the mailbox process is not standard, mailbox data collection unit 530 may determine a set of HVAC devices 220 that are related to the target HVAC devices 220 for the data collection. The related HVAC device 220 may be determined based on the total optimization requirements or may be determined based on data dependency among HVAC devices 220. In addition, mailbox data collection unit 530 may also determine data communication hubs for the target and related HVAC operation data to route through. In an embodiment, such related HVAC 220 information and data communication hub information may be initially determined by client VM registration unit 332 upon client 270 registration and may be updated/reconfirmed by mailbox data collection unit 530 upon a mailbox process being launched.

HVAC control implementation unit 540 is configured to control HVAC unit 220 based on instructions from background control unit 434 and/or foreground control unit 420. HVAC control implementation unit 540 may also control HVAC devices 220 by itself based on preset control parameters. For example, HVAC control implementation unit 540 may implement emergency control of HVAC devices 220 in case of urgent maintenance conditions.

Data harmonization unit 550 is configured to process the background data and foreground data to generate data packets respectively for the sub-process 410 and/or the foreground sub-process 430. The processing may include merging the HVAC data together using the same time scale and/or measurement units. The merging may also include removing unreasonable data and replacing missing data using suitable data interposition approaches. Data harmonization unit 550 also adds the authentication key of the relevant client VM 264 into the generated data packet. As discussed herein, a client VM 264 uses the assigned authentication key to receive data from BAS 240 and/or from virtual database 266.

Figure 6:
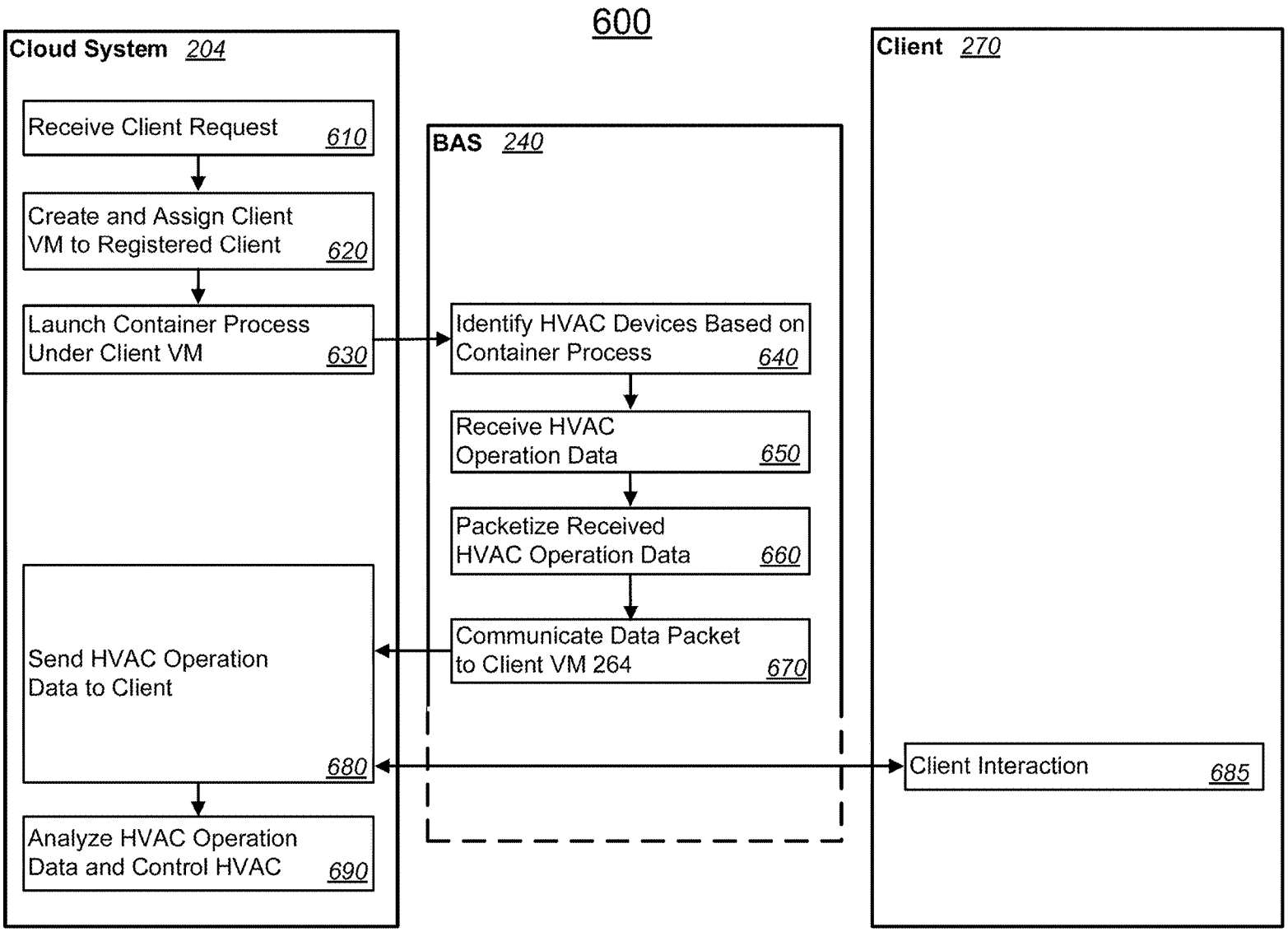
FIG. 6 is an example process of the operation of the energy optimization HVAC system.

FIG. 6 illustrates an example process 600 of system 200. Referring to FIG. 6, in example operation 610, client registration unit 332 of client VM manager 330 receives a client request from a client terminal 270 on registering a service of real time monitoring and controlling a certain HVAC devices 220 under the total optimization plan.

In example operation 620, client VM management unit 334 creates a client VM 264 and assigns the client VM 264 to the requesting client terminal 270.

In example operation 630, the client VM 264 launches one or more of container processes 268 of the client VM 264 based on the client request. The launching may immediately start the background sub-process 430. The launching may setup the foreground sub-process 410 to be ready to run and to run partially, but the foreground sub-process 410 may also need to be fully activated by client interactions.

In example operation 640, BAS 240, e.g., mailbox data collection unit 530 identifies a plurality of controllable HVAC devices 220 based on the launched container process 268. The plurality of HVAC devices 220 may include the target HVAC devices 220 that are concerned by the client 270 and related HVAC devices 220 that are related to the target HVAC devices 220 based on operation dependency, data dependency and/or data communication dependency. Mailbox data collection unit 530 may also identify one or more data communication hubs for collecting data from the plurality of HVAC devices 220.

In example operation 650, one or both of heartbeat data collection unit 520 and mailbox data collection unit 530 receive operation state data associated with each of the identified plurality of controllable HVAC devices 220.

In example operation 660, data harmonization unit 550 packetizes the HVAC operation state data received from different ones of the plurality of controllable HVAC devices 220 based on a data merging requirement of the container process 268. The data merging requirements may include various data updating rate.

In example operation 670, BAS 240 communicates in substantially real time the packetized HVAC operation state data to the client VM 264.

In example operation 680, data presentation unit 418 sends some of the packetized operation state data to client terminal 270 under the foreground sub-process 410. In an example, data presentation unit 418 sends the data packets under the foreground sub-process to client 270 upon detecting an active client interaction on the foreground sub-process 410. The data packets generated for the background sub-process 430 may not be presented to the client 270 in real time and may be made available to client 270 upon client request. In some cases, the data presentation unit 418 communicates data to the client terminal 270 via BAS 240, for example with the mailbox process described herein. In other cases, the communication of data to the client device 270 occurs outside of the BAS 240, for example via a direct secure data communication path (e.g., secure hyper text transfer protocol, HTTPS). In this respect, the communication path between exemplary operations 680 and 685 passes via a dashed line portion of BAS 240.

In an example, data presentation unit 418 may cause the foreground data packet to display on a display associated with the client terminal 270. The most updated data on HVAC operation state and/or related data analysis under the foreground sub-process 410 is displayed. The historical data, e.g., HVAC operation state data and related analysis under the background sub-process 430, may be combined with the most updated data packets and be presented to the client 270 as an optional practice upon client election.

Upon client terminal 270 receiving the packetized operation state data and related data analysis results, a user of the client terminal may be able to monitor the operation of HVAC devices 220 and may be able to determine a fault condition. When a fault condition is detected, the user may communicate HVAC correction data to the respective BAS server 240 via the foreground sub-process 410, in optional client interaction 685. Specifically, foreground control unit 420 may cause the respective BAS 240 to adjust the operation of relevant HVAC device 220 based on the HVAC correction data in example operation 690.

In example operation 690, foreground control unit 420 controls the HVAC operation based on client interactions. Further, background analyzing unit 432 and background control unit 434 may analyze the processed packetized operation state data and control the operation of one or more of the plurality of HVAC devices under the background sub-process 430. In an example, the background data analysis and control are conducted through backend operation of client VM 264 without user interaction.

As used in the present disclosure, the term "unit" refers to an application specific integrated circuit (ASIC), an electronic circuit, a processor and a memory operative to execute one or more software or firmware programs, combinational logic circuitry, or other suitable components (hardware, software, or hardware and software) that provide the functionality described with respect to the module.

The terms, "real-time" or "real time," as used herein and in the claims that follow, are not intended to imply instantaneous processing, transmission, reception, or otherwise as the case may be. Instead, the terms, "real-time" and "real time" imply that the activity occurs over an acceptably short period of time (e.g., over a period of seconds or minutes), and that the activity may be performed on an ongoing basis (e.g., receiving data randomly, periodically, scheduled, streaming, or otherwise; the data associated one or more HVAC 220, the data received at a VM layer 260 from a BAS 240). An example of an activity that is not real-time is one that occurs over an extended period of time (e.g., weeks or months).

Where the terms "substantial" or "about" in any grammatical form are used as modifiers in the present disclosure and any appended claims (e.g., to modify a structure, a dimension, a measurement, or some other characteristic), it is understood that the characteristic may vary by up to 30 percent. For example, a substantial amount of offsite software programming and configuration may be described as software programming that takes place by one or more software practitioners over a plurality of days or weeks.

In the foregoing description, certain specific details are set forth to provide a thorough understanding of various disclosed embodiments. However, one skilled in the relevant art will recognize that embodiments may be practiced without one or more of these specific details, or with other methods, components, materials, etc. In other instances, well-known structures associated with electronic and computing systems including client and server computing systems, as well as networks, have not been shown or described in detail to avoid unnecessarily obscuring descriptions of the embodiments.

Unless the context requires otherwise, throughout the specification and claims which follow, the word "comprise" and variations thereof, such as, "comprises," "comprising," "includes," and "including," are to be construed in an open, inclusive sense.

Reference throughout this specification to "one embodiment" or "an embodiment" and variations thereof means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content and context clearly dictates otherwise. It should also be noted that the conjunctive terms, "and" and "or" are generally employed in the broadest sense to include "and/or" unless the content and context clearly dictates inclusivity or exclusivity as the case may be. In addition, the composition of "and" and "or" when recited herein as "and/or" is intended to encompass an embodiment that includes all of the associated items or ideas and one or more other alternative embodiments that include fewer than all of the associated items or ideas.

The headings and Abstract of the Disclosure provided herein are for convenience only and do not limit or interpret the scope or meaning of the embodiments.

In the present disclosure, conjunctive lists make use of a comma, which may be known as an Oxford comma, a Harvard comma, a serial comma, or another like term. Such lists are intended to connect words, clauses or sentences such that the thing following the comma is also included in the list.

The various embodiments described above can be combined to provide further embodiments. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method to improve a heating, ventilation, air conditioning (HVAC) system, comprising:

with a distributed computing system accessible via a wide-area network:

receiving a request from a client computing device;

assigning a virtual machine to the client computing device; and launching a container process including a foreground sub-process and a background sub-process through the virtual machine based on the request, wherein launching the background sub-process includes automatically launching the background sub-process without interacting with the client computing device;

on a building automation system (BAS) server:

identifying a plurality of controllable HVAC devices based on the container process;

receiving operation state data associated with each of the plurality of controllable HVAC devices;

packetizing the operation state data received from different ones of the plurality of controllable HVAC devices based on a data merging requirement of the container process;

in real-time, communicating the packetized operation state data to the virtual machine; and on the client computing device:

receiving at least some of the packetized operation state data communicated to the virtual machine;

determining a fault condition; and communicating HVAC correction data to the BAS server via the container process, wherein the container process further analyzes the packetized operation state data to control operation of one or more of the plurality of HVAC devices.

2. The method of claim 1, further comprising:

on the client computing device, initiating a request for a stream of real time data associated with a selected HVAC device of the plurality of HVAC devices.

3. The method of claim 2, further comprising:

on the BAS server:

receiving the request for the stream of real time data associated with the selected HVAC device of the plurality of HVAC devices; and periodically communicating data associated with the selected HVAC device to the client computing device.

4. The method of claim 1, wherein the container process analyzing the processed data includes:

determining at least one of a climate control performance parameter and an energy saving parameter.

5. The method of claim 4, wherein determining at least one of the climate control performance parameter and the energy saving parameter includes:

determining a range of compromise between the climate control performance parameter and the energy saving parameter based on the request from the client computing device.

6. The method of claim 1, wherein identifying the plurality of controllable HVAC devices includes:

identifying a first group of controllable HVAC devices based on the request from the client computing device; and automatically identifying a second group of controllable HVAC devices on each of which at least one of the first group of controllable HVAC devices depends for at least one datum.

7. The method of claim 1, further comprising:

on the BAS server, determining a set of communication hubs associated with the plurality of HVAC devices.

8. The method of claim 1, further comprising:

on the distributed computing system accessible via the wide-area network, creating an authentication key for the container process.

9. The method of claim 8, further comprising:

on the BAS server, communicating the packetized operation state data to the virtual machine using the authentication key.

10. The method of claim 1, further comprising:

via the client computing device, displaying both a first selected portion of the packetized operation state data and a second selected portion of the analyzed packetized operation state data.

11. The method of claim 1, further comprising:

on the client computing device, associating a time stamp to each piece of received data.

12. The method of claim 1, wherein the foreground sub-process involves a first set of data associated with the plurality of HVAC devices and the background sub-process involves a second set of data associated with the plurality of HVAC devices different from the first set of data, wherein the first set of data is different from the second set of data in rate of data updating, wherein the first set of data is updated real-time and the second set of data is updated at a slower rate than the first set of data, and wherein the second set of data is analyzed during the background sub-process as a backend process without any interaction with the client computing device.

13. The method of claim 12, wherein background sub-process generates a number of key performance index values of each of the plurality of HVAC devices as the second set of data.

14. The method of claim 1, wherein launching the foreground sub-process includes launching the foreground sub-process as inactive and activating the foreground sub-process upon interacting with the client computing device.

15. A system, comprising:

a building automation system (BAS) server communicatively couple to a plurality of controllable heating, ventilation, air conditioning (HVAC) devices located in a respective building, and a distributed computing system communicatively coupled to the BAS server; and wherein, when in operation:

the BAS server:

receives operation state data from one or more of the plurality of HVAC devices;

packetizes the received operation data based on a data merging requirement; and communicates, in substantially real time, the packetized operation data to the distributed computing system; and the distributed computing system:

receives a request from a client computing device for an HVAC monitoring, analysis and control service;

assigns a virtual machine to the client computing device for the service;

launches a container process including a foreground sub-process and a background sub-process through the virtual machine based on the client request, wherein launching the background sub-process includes automatically launching the background sub-process without interacting with the client computing device, the container process analyzing the packetized operation data to control an operation of one or more of the plurality of HVAC devices based on the client request; and causes to display one or more of the packetized operation data and a result of the analyzing through the client computing device.

16. The system of claim 15, wherein the distributed computing system includes a virtual layer that includes a higher level system virtual machine that generates the virtual machine assigned to the client computing device.

17. The system of claim 15, wherein the container process analyzing the packetized operation data includes determining a balance between a climate control performance parameter and an energy saving parameter.

18. The system of claim 15, wherein the BAS server identifying the plurality of controllable HVAC devices includes:

identifying a first group of controllable HVAC devices based on the request from the client computing device; and automatically identifying a second group of controllable HVAC devices on each of which at least one of the first group of controllable HVAC devices depends for at least one datum.

19. The system of claim 15, wherein the distributed computing system further assigns a data authentication key to the virtual machine assigned to the client computing device.

* * * * *